US007975784B2

(12) United States Patent
Purcell

(10) Patent No.: US 7,975,784 B2
(45) Date of Patent: Jul. 12, 2011

(54) DRILL BIT ASSEMBLY FOR FLUID-OPERATED PERCUSSION DRILL TOOLS

(75) Inventor: Joseph Purcell, Ennis (IE)

(73) Assignee: Minroc Technical Promotions Limited (IE)

( * ) Notice: Subject to any disclaimer, the term of this patent is extended or adjusted under 35 U.S.C. 154(b) by 351 days.

(21) Appl. No.: 12/086,466

(22) PCT Filed: Jan. 4, 2007

(86) PCT No.: PCT/IE2007/000001

§ 371 (c)(1),
(2), (4) Date: Jun. 12, 2008

(87) PCT Pub. No.: WO2007/077547

PCT Pub. Date: Jul. 12, 2007

(65) Prior Publication Data

US 2010/0243333 A1 Sep. 30, 2010

(30) Foreign Application Priority Data

Jan. 4, 2006 (IE) ..... S2006/0005

(51) Int. Cl.
*E21B 10/36* (2006.01)
*E21B 4/14* (2006.01)

(52) U.S. Cl. ..... 175/414; 175/306; 166/237; 173/132

(58) Field of Classification Search ..... 175/414, 175/293, 294, 306; 166/237; 173/128–132
See application file for complete search history.

(56) References Cited

U.S. PATENT DOCUMENTS

| | | | | |
|---|---|---|---|---|
| 2,774,334 | A | 12/1956 | Cline, Jr. | |
| 3,011,570 | A | 12/1961 | Kurt et al. | |
| 3,322,216 | A * | 5/1967 | Kurt | 175/293 |
| 3,410,353 | A | 11/1968 | Martini | |
| 4,003,442 | A | 1/1977 | Bassinger | 175/410 |
| 4,862,976 | A * | 9/1989 | Meek | 175/296 |
| 5,065,827 | A | 11/1991 | Meyers et al. | 175/414 |
| 5,562,170 | A | 10/1996 | Wolfer et al. | 175/296 |
| 6,070,678 | A * | 6/2000 | Pascale | 175/300 |
| 6,698,537 | B2 * | 3/2004 | Pascale et al. | 175/300 |
| 6,705,415 | B1 * | 3/2004 | Falvey et al. | 175/74 |
| 6,789,632 | B2 * | 9/2004 | Green | 175/300 |
| 7,267,185 | B2 * | 9/2007 | Underwood et al. | 175/325.2 |
| 7,428,938 | B2 * | 9/2008 | Marshall | 175/414 |
| 7,748,478 | B2 * | 7/2010 | Swadi | 175/296 |
| 2006/0096787 | A1 * | 5/2006 | Underwood et al. | 175/294 |

(Continued)

FOREIGN PATENT DOCUMENTS

| | | |
|---|---|---|
| WO | WO 96/15349 | 5/1996 |
| WO | WO 98/05476 | 2/1998 |

(Continued)

*Primary Examiner* — Jennifer H Gay
(74) *Attorney, Agent, or Firm* — Kusner & Jaffe

(57) ABSTRACT

A drill bit assembly for fluid-operated percussion drill tools. The assembly comprises a percussion bit (1) having a head portion (3) formed with an axially extending stub shank (32). A drive bush (2) is releasably connectable to the bit head portion (3). Axially extending splines (35) on the drive bush (2) are slideably engageable with complementary splines (36) formed on a drive chuck (4) whereby rotational drive from the chuck (4) may be transmitted to the drive bush (2). The assembly further comprises engagement means on the chuck (4) adapted for connecting the chuck (4) to a drive means (5) of the fluid-operated percussion drill tool.

7 Claims, 4 Drawing Sheets

U.S. PATENT DOCUMENTS

| | | | | |
|---|---|---|---|---|
| 2007/0137895 | A1* | 6/2007 | Marshall et al. | 175/57 |
| 2007/0261885 | A1* | 11/2007 | Marshall | 175/57 |
| 2010/0012380 | A1* | 1/2010 | Swadi | 175/57 |
| 2010/0108395 | A1* | 5/2010 | Purcell | 175/296 |
| 2010/0243333 | A1* | 9/2010 | Purcell | 175/414 |

FOREIGN PATENT DOCUMENTS

| | | | |
|---|---|---|---|
| WO | WO 03/062585 | | 7/2003 |
| WO | WO 03/062586 | | 7/2003 |
| WO | WO 2004031530 | A1 * | 4/2004 |

* cited by examiner

DRILL BIT ASSEMBLY FOR FLUID-OPERATED PERCUSSION DRILL TOOLS

TECHNICAL FIELD OF THE INVENTION

The present invention relates to a drill bit assembly for fluid-operated percussion drill tools. In particular, the invention concerns a drill bit assembly for use with "down-the-hole" hammers.

BACKGROUND TO THE INVENTION

Some designs of conventional down-the-hole hammers and fluid-operated percussion drill tools comprise an external cylinder or outer wear sleeve, within which is mounted an inner cylinder which in turn engages with a backhead assembly. A sliding reciprocating piston co-operates with the inner cylinder and backhead assembly, which when air pressure is supplied through the backhead assembly, acts with a percussive effect on a drill bit retained within a chuck on the outer wear sleeve.

Typically the inner cylinder is mounted co-axially within the outer wear sleeve. A sliding piston is mounted for reciprocating movement within the inner cylinder and the outer wear sleeve, to strike a hammer bit mounted for sliding movement in a chuck located at the forward end of the outer wear sleeve, in well known manner. A foot valve is positioned above the bit.

Our prior patent application Publication No. WO 2004/031530, discloses a down-the-hole hammer in which the bit has an elongate shank portion which at its upper end has an annular strike face (or anvil) against which the piston impacts to impart a percussive force to the bit. A lower end of the bit shank is formed externally with a plurality of splines which are spaced around the circumference of the bit shank and extend in the axial direction. The splines slideably engage with complementary splines formed on the internal wall of an annular chuck. The chuck is screw-threadably connected to the bottom of the outer wear sleeve.

The bit is rotationally driven by the chuck, and rotational torque is transferred to the top portion of the elongate shank portion. That is, rotational torque is transferred to a part of the bit shank remote from the cutting face of the bit. This imparts significant bending moments on the upper part of the bit shank increasing the risk of breakage of the shank due to cracking. Drill bits are very expensive to produce, and to recover if they are lost down the drilling hole. That this is a significant problem with the drill bits of conventional down-the-hole hammers is evidenced by the fact that there are a number of patents directed to means of retaining a broken-off bit within the bit assembly so as to prevent it falling down the drill hole. Examples of these patents are U.S. Pat. No. 5,065,827, U.S. Pat. No. 4,003,442, WO 96/15349, WO 98/05476, WO 03/062585, WO 03/062586.

However, the inventions disclosed in these patents are directed to dealing with problems which occur after the bit shaft has fractured, and not to preventing the breakage in the first place.

Other disadvantages associated with conventional percussion drill tools, such as down-the-hole hammers, is that the bit has a long shank portion which is expensive to produce. As indicated above, rotational torque is transferred to the bit in the weaker shank area, and more remote from the cutting face of the bit. Also relatively expensive machining of the shank is required due to the necessity to form splines on the shank. In conventional hammers, when the bit head or cutting face is worn out, the shank can often be in good condition but because it is made integral with the cutting face, it must be discarded. The premature wearing out of the head/cutting face may occur where drilling is carried out in very abrasive rock or material which wears the tungsten carbide inserts in the cutting heard. With many conventional hammers, there is a need to provide foot valves in the bit. The foot valve is required as an integral part of the functioning of the hammer i.e. when the piston is in the strike position, the bottom lift chamber is sealed by the bore of the piston and the outside of the footvalve. If this were not the case then the piston would not lift. The footvalve is prone to occasional breakage leading to down-time.

OBJECT OF THE INVENTION

It is an object of the invention to provide a bit mounting system for a down-the-hole hammer, or other fluid operated percussion drill tool which avoids many of the advantages of the prior art systems as described above. It is also an object of the invention to provide a bit system in which the shank is shorter in length than conventional drill shanks. It is also an object of the invention to provide an improved coupling means for the bit assembly.

SUMMARY OF THE INVENTION

In one aspect the invention provides a drill bit assembly for fluid-operated percussion drill tools comprising a percussion bit having a head portion formed with an axially extending stub shank, a drive bush releasably connectable to the bit head portion, axially extending splines on the drive bush slideably engageable with complementary splines formed on a drive chuck whereby rotational drive from the chuck may be transmitted to the drive bush, and engagement means on the chuck adapted for connecting the chuck to a drive means of the fluid-operated percussion drill tool.

Preferably, the head portion has an external screw-thread which engages with a complementary internal screw-thread formed on an inner cylindrical wall of the drive bush; and the drive chuck is formed with a screw thread which is adapted to engage with a complementary screw thread on the lower end of a wear sleeve of the drill tool. Suitably, the axially extending splines are formed on an internal cylindrical wall of the bush and engage with complementary splines formed externally of the drive chuck.

In a second embodiment the chuck is formed in two parts. Preferably, a lower part of the chuck formed with splines for engagement with the splines of the drive bush, and an upper part has screw-threads for engagement with the wear sleeve. Preferably, the splines of the lower part are formed with a stop, e.g. in the form of a raised diameter, which prevents the bush end of the bit from falling from the assembly, in the event of a breakage during operation of the drill bit.

In another aspect, the invention provides a down-the-hole hammer comprising an external cylindrical outer wear sleeve, a sliding piston mounted for reciprocating movement within the outer wear sleeve to strike a percussion bit of a drill bit assembly located at the forward end of the outer wear sleeve, in which the drill bit assembly is as described above.

The drill bit assembly of the invention has a number of advantages over conventional systems. The bit having a short stub shaft is less expensive to manufacture than bit heads having long shafts. There is the added benefit of providing the strike energy closer to the bit cutting face. Also, the rotational torque is transferred through the strongest part of the bit closer to the cutting face.

Another advantage is that it is much cheaper to replace the bit in abrasive conditions, as compared to conventional drill bit assemblies where the bit head with attached long shaft and machined shaft has to be replaced. Furthermore, with the assembly of the invention there is no need to have a footvalve in the bit. The footvalve and piston cooperation of the prior art may be replaced in the invention by the nose of the piston 8 sealing in the bore of the chuck 4. Nevertheless, it is optional whether a footvalve is used or not.

The systems described in WO 96/15349 and U.S. Pat. No. 4,003,442 (referred to above) have threadably detachable bit heads. This can lead to problems when the thread loosens because all force is transferred over the threads leading to breakages. In the present invention even if the threads loosen between the drive bush and the bit, the percussive forces are still transferred through the bit and not the threads.

BRIEF DESCRIPTION OF THE DRAWINGS

One embodiment of a down-the-hole hammer having a bit coupling system in accordance with the invention will now be described with reference to the accompanying drawings, wherein.

DETAILED DESCRIPTION OF THE DRAWINGS

Figures 1, 2, 3:
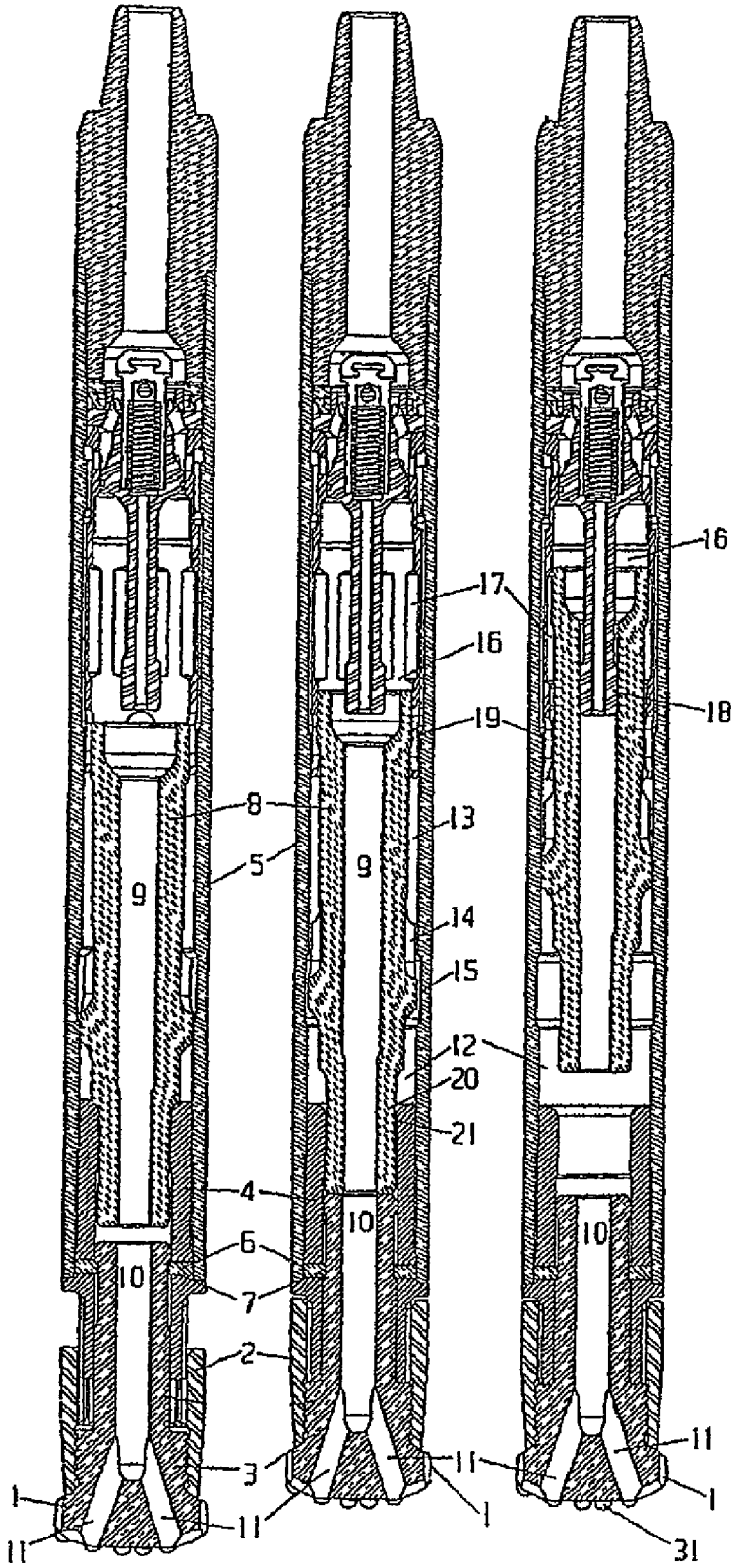
FIG. 1 is a sectional side elevation of a down-the-hole hammer of the invention, showing the piston in an off-bottom position.
FIG. 2 is a sectional side elevation of the down-the-hole hammer of FIG. 1, showing the piston in the strike position.
FIG. 3 is a sectional side elevation of the down-the-hole hammer of FIG. 1, showing the piston at the top-of-stroke position.

Referring to the drawings, an embodiment of a down-the-hole hammer of the invention comprises an external cylindrical outer wear sleeve 5. An inner cylinder is mounted co-axially within the outer wear sleeve 5. A sliding piston 8 is mounted for reciprocating movement within the inner cylinder and the outer wear sleeve 5, to strike a hammer bit 1 located at the forward end of the outer wear sleeve 5 to exercise a percussive force to the drill bit. Rotational forces are transferred from the rotating outer wear sleeve 5 by means of a chuck 4 and connector means as described more fully below. The wear sleeve is threadably connected to a drill string which is connected to a rotation motor on a drilling rig at the surface.

Figure 4:
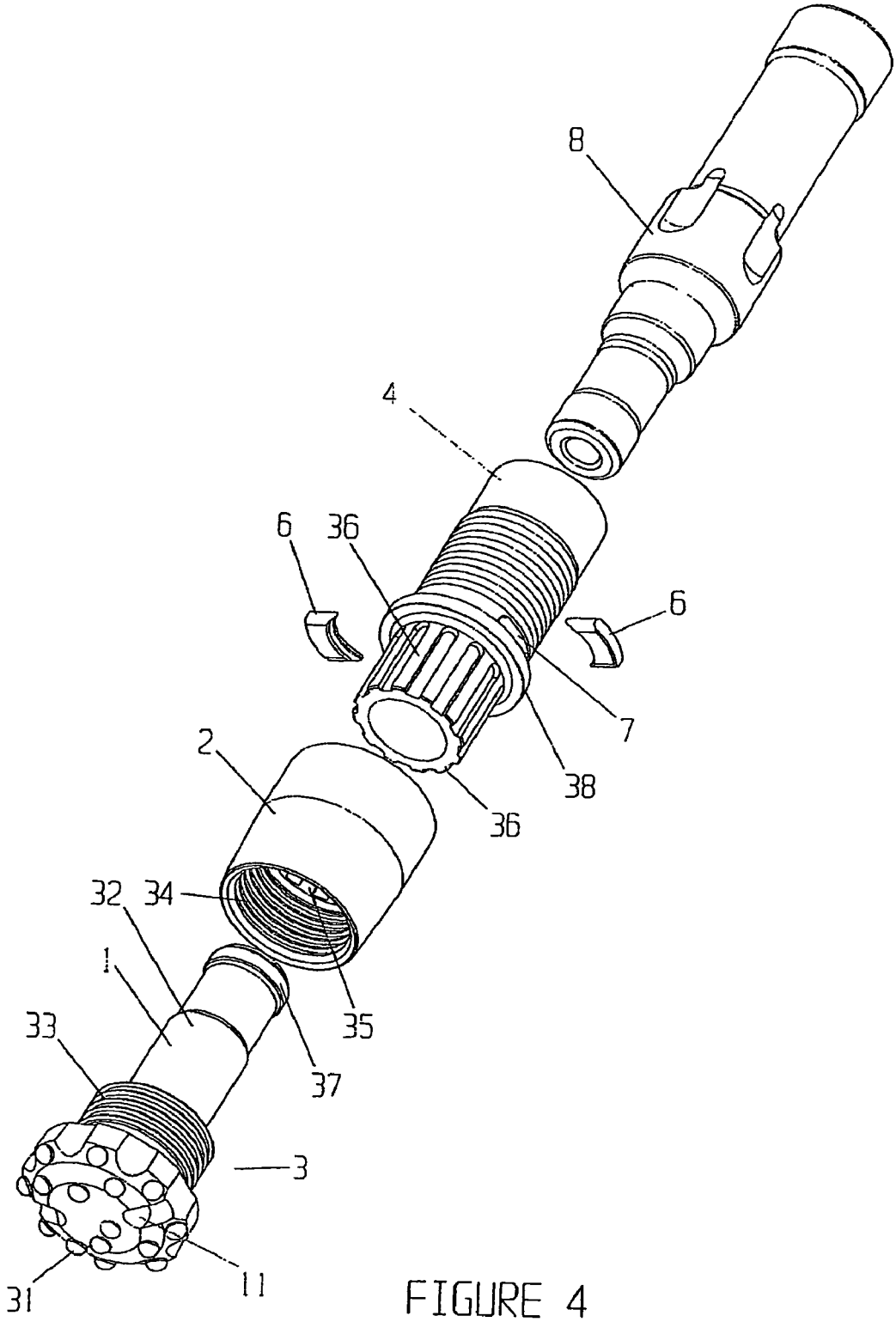
FIG. 4 is an exploded perspective view of the bit coupling system of the invention.
Figure 5:
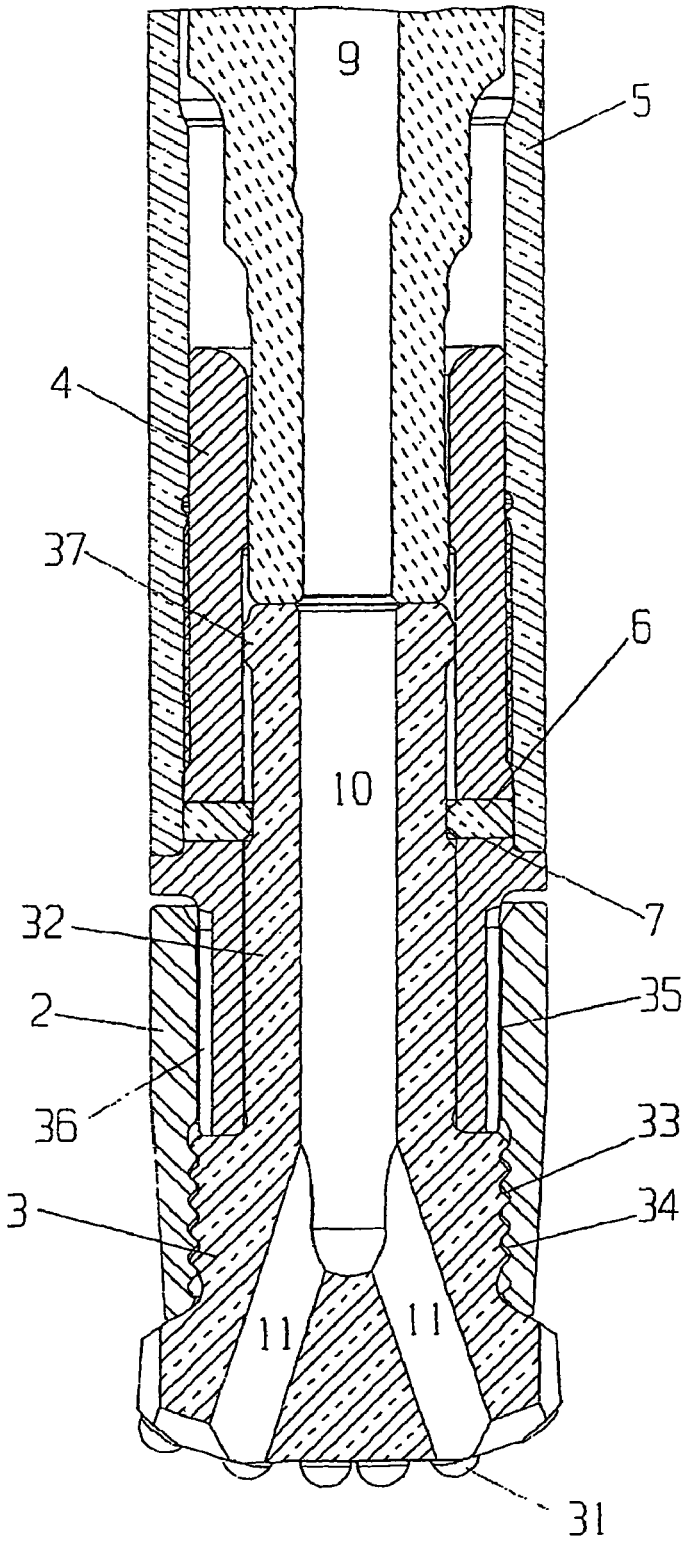
FIG. 5 is an enlarged sectional side elevation substantially of the lower part of FIG. 2.

Referring particularly to FIGS. 4 and 5, the head portion 3 of the bit assembly comprises the percussion bit 1 which is provided with tungsten carbide inserts 31, in well know manner. The bit head portion 3 is formed with an axially extending stub shank 32. The stub shank 32 is formed with a shoulder portion 33 abutting the bit 1. The annular shoulder portion 33 is externally screw threaded. Rotational torque is applied to the bit head portion 3 through a drive bush 2. A lower portion of the internal wall of the bushing 2 is formed with screw threads 34 which engage with the external screw threads of shoulder 33 to enable the bush 2 to be screwed onto the head portion 3 of the bit.

The upper internal wall portion of the drive bush 2 is machined internally to form axially extending internal splines 35.

A hollow cylindrical chuck 4 is provided, on its lower external wall with a plurality of axially extending splines 36 which engage with the splines 35 of the drive bush 2 to transmit rotational drive from the chuck 4 to the drive bush 2. The splines 36 terminate at their upper end with an annular shoulder 38, which acts as a stop when the chuck 4 is screwed into the wear sleeve 5 as described below. Above the shoulder 38, an number of slots 7 are cut through the wall of the chuck 4 to receive retaining pieces 6. In the assembled bit assembly, the bit retaining pieces 6 engage with the underside of an annular shoulder 37 formed at the top end of the shank 32. The chuck 4 is, in turn, screwed into the lower end of the wear sleeve 5 and, in doing so retains the bit retaining pieces 6 in slot 7. In addition, the screw threaded engagement of the chuck 4 with the wear sleeve 5 enables rotational torque to be transmitted from the wear sleeve 5 through the chuck 4, and drive bush 2, to the bit 1.

It will be appreciated that, alternatively, the splines 35 could be formed externally of the drive bush 2, and the splines 36 of the chuck 4 formed internally of the chuck. Also, in an alternative arrangement of the chuck 4 the external screw threads may be replaced with internal threads so that the chuck can engage with complementary external screw threads on the wear sleeve 5.

A reciprocating piston 8 is mounted for reciprocating movement within the inner cylinder 25 and the outer wear sleeve 5 to strike the top face of shoulder 37 to impart a percussive force to the bit. The splines 35 of the bush 2 slideably engage with the complementary splines 36 on the chuck 4 so that the bush 2 and head portion 3 are moved axially relatively to the chuck during the percussive action.

In an embodiment of the invention, which has a nominal 4" hammer which drills hole sizes of 10 cm and greater, the stub shaft 32 has a length in the range 90 mm to 140 mm, preferably about 130 mm. In contrast the long shank portions of conventional down-the-hole hammers, of similar drill size, typically have a length in the range 200 mm to 260 mm. Thus, with the present invention the length of the shaft 32 can be about 50% less than that of the shafts of conventional down-the-hole hammers.

The hammer cycle is as shown in FIGS. 1 to 3. FIG. 1 shows the hammer in the off-bottom position. Piston 8 is permitting exhaust air to flush through bore 9 and bore 10 in bit 1 to the face flushing holes 11. FIG. 2 shows the hammer in the strike position. Pressurised air is supplied down chamber 13, through piston grooves 14 and wearsleeve undercut 15, into the pressure chamber 12. This air is sealed off by the piston nose 20 and chuck bore 21. Simultaneously, the top chamber 16 is open to exhaust through bores 9, 10 and 11. As a result the piston 8 lifts. FIG. 3 shows the piston 8 at the top of stroke. Lift chamber 12 is open to exhaust through chuck 4 and bores 10, 11. Top chamber 16 is supplied with pressure air through ports 19 and channels 17. The chamber 16, is sealed by the distributor probe 18. As a result the piston is forced down to strike the bit and repeat the cycle.

Figure 6:
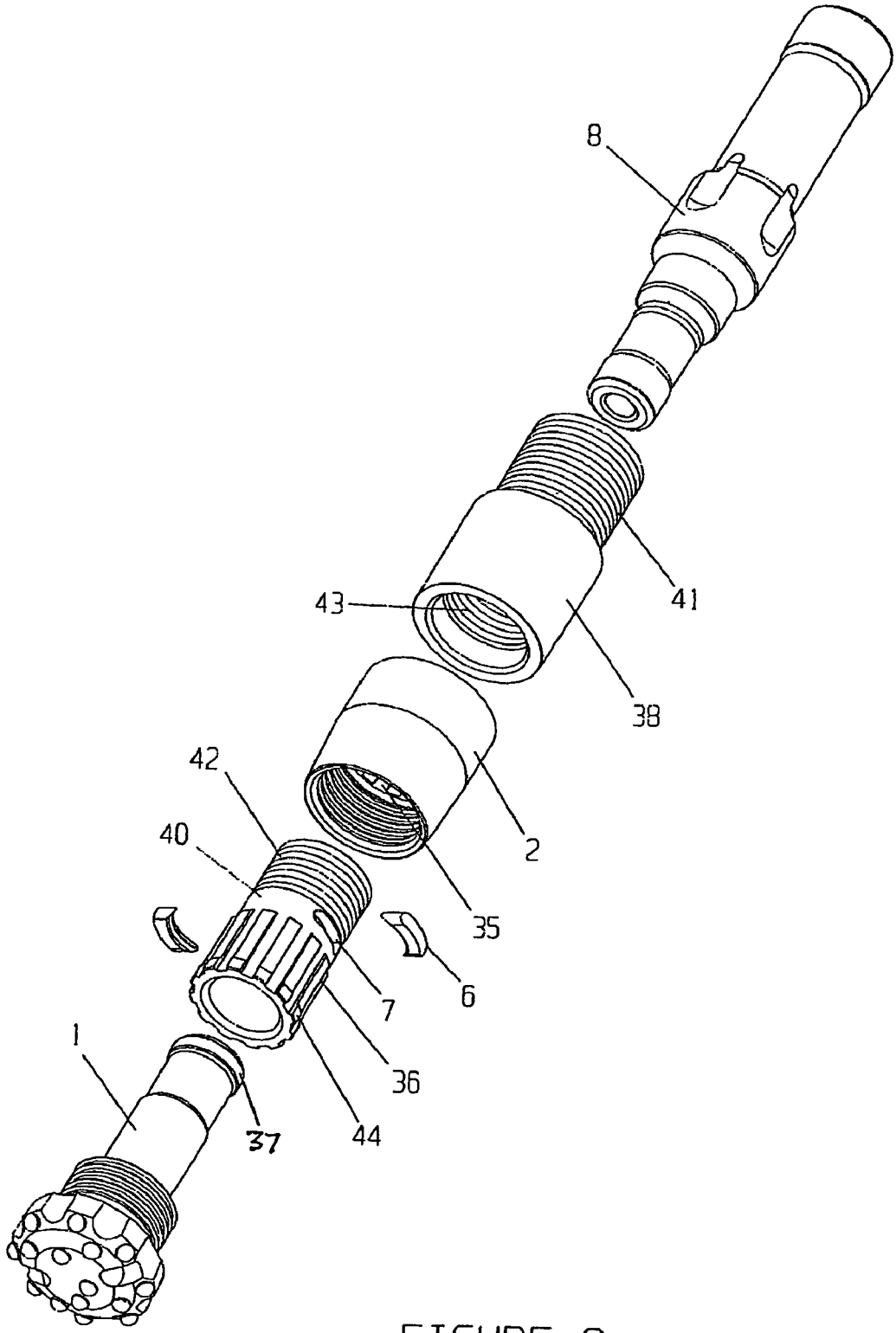
FIG. 6 is an exploded perspective view of a second embodiment of the invention.

In an alternative embodiment, shown in FIG. 6, the chuck 4 is formed in two parts, namely a lower part 40 having the splines 36, and an upper part 41 having the screw-threads for connection to the wear sleeve.

The two parts 40, 41 of the chuck are connected by screw-threads 42 on the lower part 40 which engage with complementary screw-threads 43 on the upper part 41.

This arrangement has the advantage of ease of assembly at the parts of the drill bit system. The parts can be assembled from above by sliding the splines 36 of the lower part 40 of the chuck 4 into engagement with the splines 35 of the bush 2 so that the lower part 40 fits within the bush 2.

The retaining pieces 6 are held in slots 7 machined in the lower part 40 of the chuck 4 and held in position when the upper part 41 of the chuck 4 is screwed into engagement with the lower part 40. The advantage of this is that there is a secondary retaining area for the assembly which is in the form of a raised diameter 44 at the bottom end of the splines 36 of the chuck 4 which serves to cooperate with the top ends of the splines 35 on the bush 2.

The raised diameter portion (, or stop,) 44 ensures that, in operation of the hammer, the bush 2 cannot slide off the ends of the splines 36. Thus, in the event of a breakage of the bit 1 in the region of the stub shank 32 or the shoulder 37, or in the event of a failure of the retaining pieces 6, the raised portion (, or stop,) 44 serves as a stop to prevent the bush 2 and the bit 1 from falling from the assembly.

The words "comprises/comprising" and the words "having/including" when used herein with reference to the present invention are used to specify the presence of stated features, integers, steps or components but does not preclude the presence or addition of one or more other features, integers, steps, components and groups thereof.

From the foregoing, it will be apparent that numerous modifications and variations can be effected without departing from the true spirit and scope of the novel concept of the present invention. It will be appreciated that the present disclosure is intended to set forth the exemplifications of the invention which are not intended to limit the invention to the specific embodiments illustrated. The disclosure is intended to cover by the appended claims all such modifications as fall within the scope of the claims.

Where technical features mentioned in any claim are followed by reference signs, these reference signs have been included for the sole purpose of increasing the intelligibility of the claims and accordingly, such reference signs do not have any limiting effect on the scope of each element identified by way of example by such reference signs.

The invention claimed is:

1. A drill bit assembly for fluid-operated percussion drill tools comprising:

a percussion bit having a head portion formed with an axially extending shank wherein the shank is a stub shank having a top face adapted for striking by a piston to impart a percussive force to the bit, a drive bush releasably connectable to the head portion of the bit by means of an external screw-thread on the head portion which engages with a complementary internal screw-thread formed on an inner cylindrical wall of the drive bush, the drive bush also having axially extending splines formed on the inner cylindrical wall of the drive bush, and a drive chuck having complementary splines formed externally therein that are slideably engageable with the axially extending splines on the drive bush whereby rotational drive from the chuck is transmitted to the drive bush to drive the bit, and engagement means on the chuck is adapted for connecting the chuck to a wear sleeve of a fluid-operated percussion drill tool.

2. The drill bit assembly as claimed in claim 1, wherein the drive chuck is formed with a screw thread which is adapted to engage with a complementary screw thread on the lower end of the wear sleeve of the drill tool.

3. The drill bit assembly as claimed in claim 1, wherein the chuck is formed in two parts.

4. The drill bit assembly as claimed in claim 3 wherein a lower part of the chuck is formed with the complementary splines for engagement with the axially extending splines of the drive bush, and an upper part has screw-threads for engagement with the wear sleeve.

5. The drill bit assembly as claimed in claim 4 wherein the complementary splines on the lower part are formed with a stop.

6. The drill bit assembly as claimed in claim 3, wherein the stop is in the form of a raised diameter.

7. A down-the-hole hammer comprising an external cylindrical outer wear sleeve, a sliding piston mounted for reciprocating movement within the outer wear sleeve to strike the percussion bit of the drill bit assembly located at the forward end of the outer wear sleeve wherein the drill bit assembly is an assembly as claimed in claim 1.

* * * * *